US005189898A

United States Patent [19]

Hamilton

[11] Patent Number: 5,189,898

[45] Date of Patent: Mar. 2, 1993

[54] HEAVY DUTY AUXILIARY TOWER FOR A REPAIR RACK

[75] Inventor: Harold F. Hamilton, West Allis, Wis.

[73] Assignee: Hein-Werner Corporation, Waukesha, Wis.

[21] Appl. No.: 769,864

[22] Filed: Oct. 1, 1991

[51] Int. Cl.[5] ..... B21D 1/12

[52] U.S. Cl. ..... 72/457; 72/705

[58] Field of Search ..... 72/447, 457, 705

[56] References Cited

U.S. PATENT DOCUMENTS

| | | | |
|---|---|---|---|
| 3,340,720 | 9/1967 | Chartier | 72/705 |
| 4,057,994 | 11/1977 | Wolgast et al. | 72/705 |
| 4,643,015 | 2/1987 | Larson et al. | 72/705 |
| 4,932,236 | 6/1990 | Hinson | 72/705 |

*Primary Examiner*—Lowell A. Larson
*Attorney, Agent, or Firm*—Foley & Lardner

[57] ABSTRACT

An anchor force assembly mounted on a repair rack or on the floor in a spaced relation to a pull tower having a chain for applying a tensile force to the damaged vehicle, the anchor force assembly including a base plate assembly which is adapted to be mounted on the edge of the top of the rack, or on the floor, the base plate assembly including a base plate having a clamp mounted on each end, a pair of spacer blocks mounted on the base plate and a tower assembly pivotally mounted on said base plate assembly, the tower assembly including a pivot plate pivotally secured to the plate assembly, a tubular vertical member mounted on said plate, a tubular horizontal member mounted on said plate with one end abutting the vertical member and a tubular gusset mounted between said horizontal and vertical member whereby the chain can be attached to the vehicle with the end of the chain attached to the auxiliary tower whereby the force generated by the pull tower is doubled.

8 Claims, 3 Drawing Sheets

HEAVY DUTY AUXILIARY TOWER FOR A REPAIR RACK

FIELD OF THE INVENTION

The present invention relates to frame straightening equipment wherein a damaged vehicle is supported on a rack or floor, and a number of pulling towers are provided around the vehicle to apply forces to the damaged areas of the vehicle and more particularly to a heavy duty auxiliary tower which can be selectively mounted on the rack or floor, and coupled to one of the pulling towers to double the pulling force of the tower.

BACKGROUND OF THE INVENTION

Collision repair of the type contemplated herein generally includes a rack or floor system, on which a vehicle is anchored and a plurality of pulling towers which are mounted on the rack or anchored to the floor for applying a tensile or pulling force on the damaged area of the vehicle. The towers are generally freely movable about the perimeter of the vehicle for easy alignment with the damaged area of the vehicle. A chain is provided on the tower which can be adjusted to any height and is attached directly to the damaged part of the vehicle. A hydraulic force is applied to the chain which is used to pull the damaged area back to its original shape. When heavy pulls are required a second pulling tower is moved in close proximity to the first tower in order to obtain a sufficient force to return the damaged area to its original shape.

SUMMARY OF THE PRESENT INVENTION

The heavy duty auxiliary tower according to the present invention includes a base plate assembly which is simply and easily attached to the rack or floor, and an auxiliary tower assembly pivotally mounted on the base plate assembly. The chain on the pulling tower is passed through a snap block and hook assembly and connected to the auxiliary tower. The block and hook assembly is connected to the damaged area of the vehicle. The base plate assembly is positioned so that the chain is aligned at the same level as the snap block assembly. On application of a force on the chain a double force is achieved which increases the pulling force of the tower from a normal 5,000 lb. pull to a 10,000 lb. pull.

One of the primary advantages of the heavy duty auxiliary tower is the ability to simply and easily mount the auxiliary tower at any point around the vehicle.

A further advantage of the heavy duty auxiliary tower is the ability to change the angle of correction or pull by aligning the auxiliary tower assembly in the direction of the pulling force to thereby equalize the force on the damaged vehicle.

Another advantage of the auxiliary tower is the ability to be used as a nonpull tower or anchoring device.

Other principal features and advantages of the invention will become apparent to those skilled in the art upon review of the following drawings, the detailed description and the appended claims.

Figure 1:
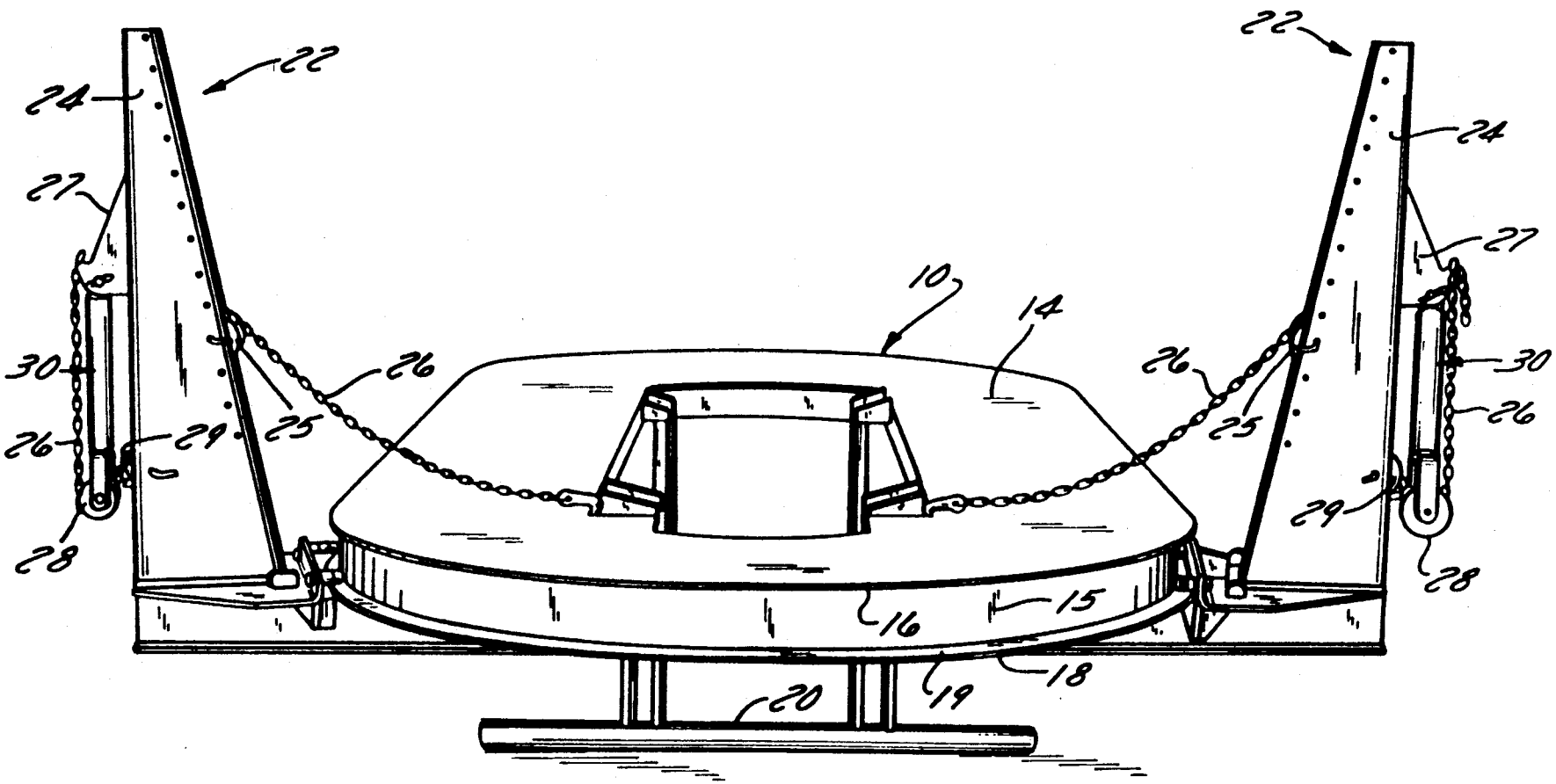
FIG. 1 is a perspective view of a repair rack of the type contemplated herein.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

As shown in the drawings a rack 10 of the type contemplated herein generally includes an upper plate 14 for supporting a vehicle and defining an upper track 16 around the outer perimeter of the rack. A lower plate 18 is spaced beneath the upper plate by a web 15. The lower plate 18 defines a lower track 19 around the perimeter of the rack. The rack is supported on the floor by legs 20.

A number of pulling towers 22 are mounted on the lower track 19 which are free to move about the perimeter of the lower track 19 to any desired location. Each tower includes a vertical member 24 having (a chain 26 wrapped around) an adjustable pocket wheel 25 located on the front of the tower and guide roller 29 at the back of the tower. A pocket wheel 28 is mounted on a hydraulic piston and cylinder assembly 30 provided on the back of the tower. A chain 26 is wrapped around pocket wheel 28, guide roller 29 and pocket wheel 28. One end of the chain 26 is secured to a bracket 27 located at the back of the tower. The other end of the chain 26 is connected to the damaged part. A tensile force is applied to the chain 26 by extending the piston in assembly 30.

Figure 2:
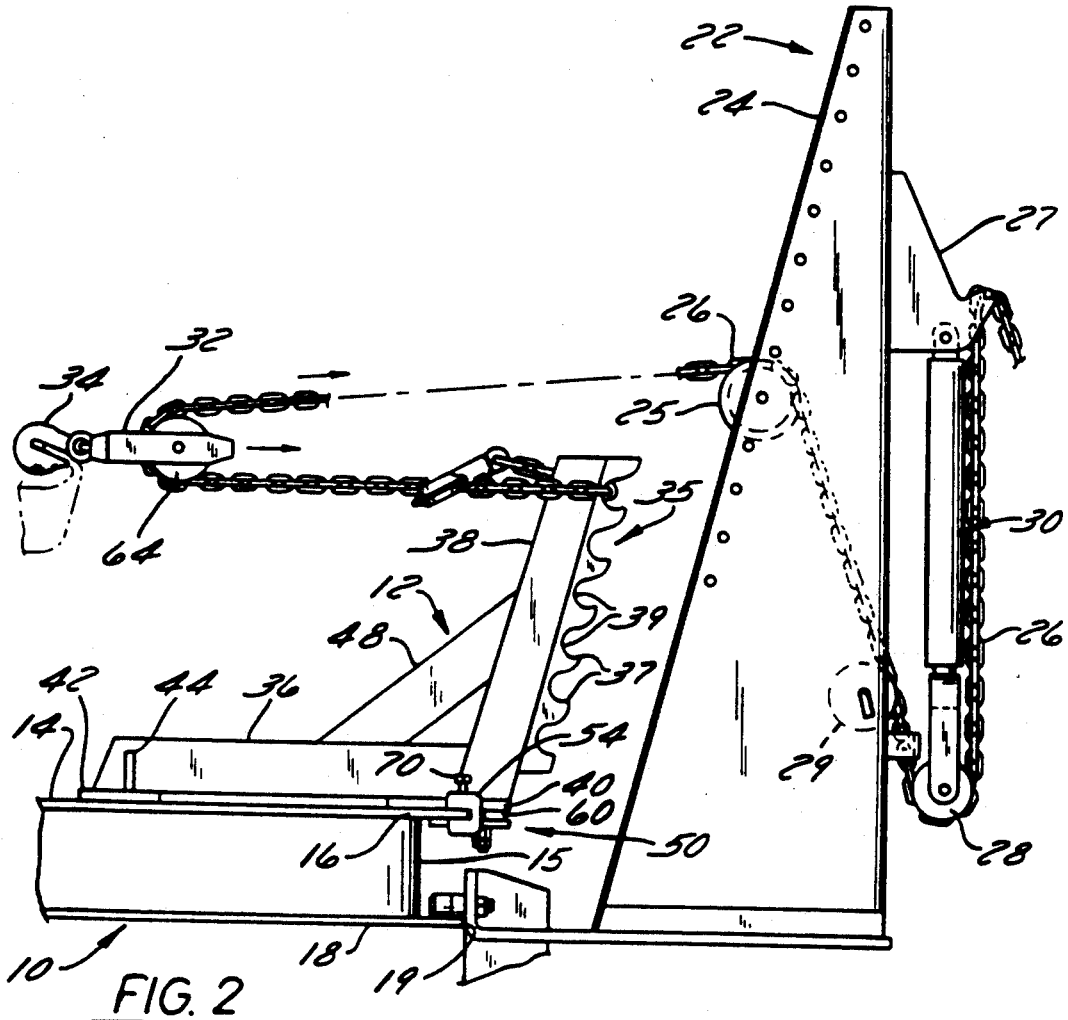
FIG. 2 is a side view of the rack showing the auxiliary tower according to the invention mounted on the rack and connected to a pulling tower.
Figure 3:
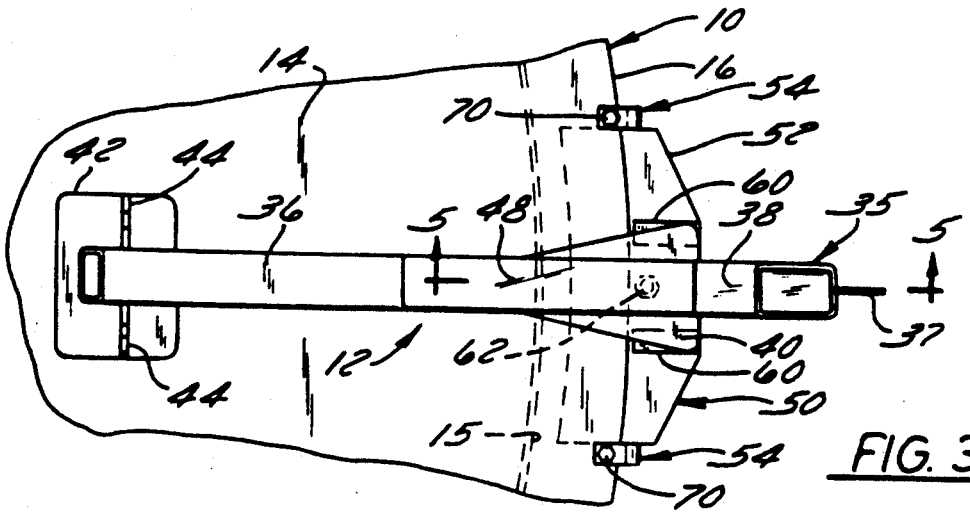
FIG. 3 is a top view of the auxiliary tower shown mounted on the rack.
Figure 4:
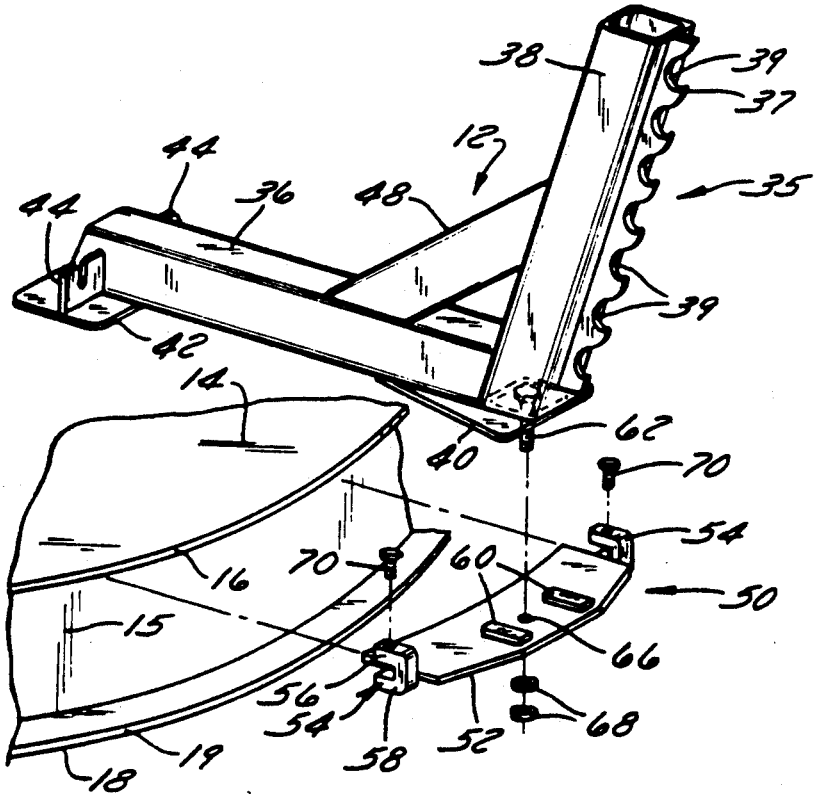
FIG. 4 is an exploded perspective view of the auxiliary tower.
Figure 5:
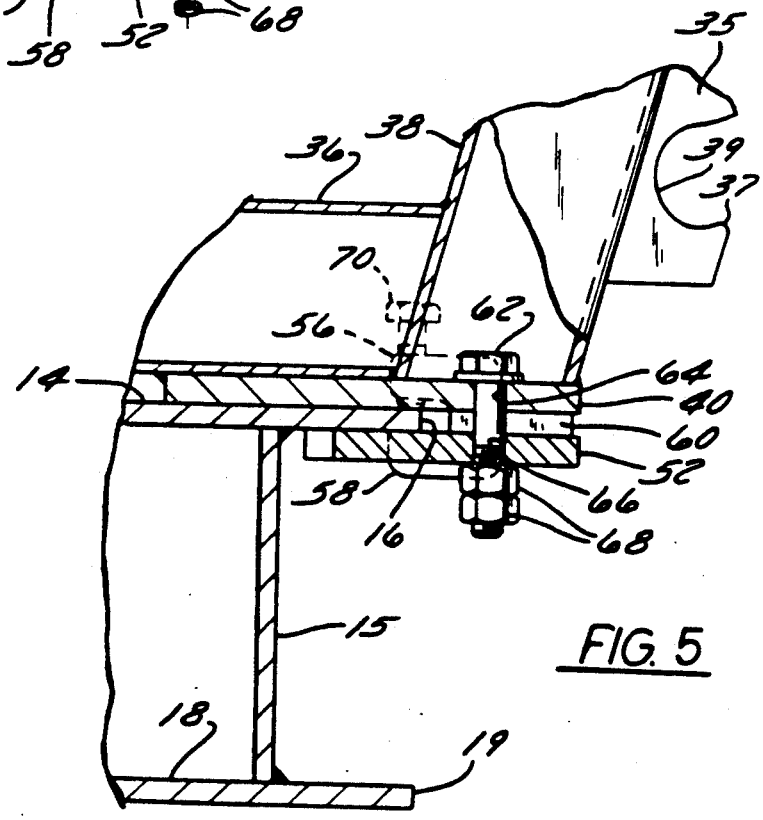
FIG. 5 is a view taken on line 5—5 of FIG. 3.

In accordance with the present invention the heavy duty auxiliary tower 12 as shown in FIG. 2 is secured to the upper track 16 on rack 10. The chain 26 is passed through a snap block 32 and connected to the auxiliary tower 12. A hook 34 in snap block 32 is connected to the damaged area of the vehicle.

The auxiliary tower 12 generally includes a tower assembly 35 and a cap plate assembly 50. The tower assembly 35 includes a base plate 40 having a horizontal tube 36 and a vertical tube 38 mounted thereon. A spacer bar 37 having a plurality of recesses 39 is mounted on the back of vertical tube 38. A flat plate 42 is provided at the end of the horizontal tube 36 with an ear plate 44 provided on each side of the horizontal tube. A tubular gusset 48 is provided between the horizontal tube 36 and the vertical tube 38. The tower assembly 35 is secured to the upper track 16 of the rack by means of the cap plate assembly 50.

In this regard, the assembly 50 includes a cap plate 52 having a lug plate 54 mounted on each end. Each lug plate includes an upper arm 56 and a lower arm 58. The lower arm 58 is aligned with the upper surface of the cap plate 52. The upper arm 56 is spaced from the lower arm 58 a distance slightly greater than the thickness of upper plate 14 on the rack 10. A pair of spacer plates 60 are provided on the upper surface of the cap plate 52 to space the tower assembly 35 from the cap plate assembly 50 a distance equal to the thickness of the plate 14.

The cap plate assembly 50 is secured to the tower assembly 35 by means of a bolt 62 which is positioned in a hole 64 provided in the base plate 40 and a hole 66 provided in the cap plate 52. The bolt 62 is locked in position by lock nuts 68 with the base plate 40 seated on the spacer plates 60. It should be noted that the spacer plate 60 has a thickness substantially equal to the thickness of the upper plate 14 on the rack. The cap plate assembly 50 is mounted on the upper track 16 by aligning the upper track 16 in the space between the upper leg 56 and lower leg 58 of the lug plates 54. Bolts 70 are provided in the upper legs 56 for securing the cap plate assembly 50 to the upper track on the rack. The tower assembly 35 can be pivoted about the bolt 62 to align the horizontal tube 36 with the point of connection of the chain to the snap block 34. As shown in FIG. 2 the chain 26 can be attached to and retained at various elevations with respect to the vertical tube 38 by wrapping the chain through one of the recesses 39 in the spacer plate 37 provided on the back of the vertical tube 38.

In operation once the auxiliary tower has been mounted on the rack 10, the chain 26 is wrapped around a pocket wheel 64 in the snap block assembly with the end of the chain secured to the vertical tube 38 on the auxiliary tower. On application of a tensile force to the chain 26, the hook 34 on the snap block will exert a force to the damaged area that is double the force applied by the hydraulic system on the pulling tower.

Although the auxiliary tower has been shown and described in connection with a work rack, it should be understood that the tower could also be mounted directly on the floor. In this regard, standard type chain anchors could be attached directly to the tower assembly 35 and to existing anchor pots provided in the floor. In an alternate arrangement, an auxiliary plate is anchored to the floor to support the auxiliary tower. The auxiliary plate should be spaced a distance from the floor sufficient for the cap plate assembly 50 to engage the edge of the auxiliary plate.

Thus, it should be apparent that there has been provided in accordance with the present invention a heavy duty auxiliary tower for a repair rack that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. In an apparatus for repairing and straightening vehicles including a rack having upper and lower tracks, a plurality of pull towers mounted on said lower track for movement around the rack, each pull tower including a tension member having a free end for attachment to the damaged area of the vehicle, the improvement comprising an auxiliary tower mounted on said upper track in close proximity to one of the pull towers whereby said tension member can be attached to said vehicle with said free end of said tension member attached to said auxiliary tower whereby a tensile force applied to the chain will be doubled at the point of connection of the chain to the damaged vehicle.

2. The auxiliary tower according to claim 1 wherein said auxiliary tower includes a tower assembly and a cap plate assembly, said cap plate assembly being mounted on the upper track, said tower assembly includes a base plate, a horizontal member mounted on said base plate and extending inwardly on the rack, a vertical member secured to said base plate at the outer end of said horizontal member and a gusset member positioned between said horizontal member and said vertical member whereby said vertical member is prevented from movement with respect to said horizontal member on application of a pull force on the tension member.

3. The auxiliary tower according to claim 2 wherein said cap plate assembly includes a cap plate, a pair of spacer plates mounted on said cap plate for separating said tower assembly from said cap plate a distance equal to the thickness of said upper track.

4. The apparatus according to claim 3 including a clamp mounted on each end of said cap plate for securing said cap plate assembly to said upper track.

5. The apparatus according to claim 4 including means on said vertical member for supporting said tension member at predetermined heights.

6. An anchor force assembly arranged to be mounted on a rack or floor in a spaced relation to a pull tower for doubling the force applied to a vehicle to be repaired, the pull tower including a chain having a free end for attachment to a vehicle, said assembly comprising a cap plate assembly including a cap plate, a pair of lugs mounted on each end of said cap plate, a pair of spacer blocks mounted on said cap plate, and a tower assembly pivotally mounted on said cap plate assembly, said tower assembly including a base plate pivotally secured to said cap plate assembly, a tubular horizontal member mounted on said cap plate, a tubular vertical member mounted on said cap plate and a tubular gusset mounted between said tubular member and said tubular horizontal member, whereby the chain can be attached to the vehicle and the free end of the chain attached to said anchor force assembly to double the pull force of the chain.

7. The combination with one or more pull towers mounted around the perimeter of a damaged vehicle, each pull tower including a chain having a free end for attachment to the damaged area of a vehicle, and one or more auxiliary towers for repairing damaged vehicles, each of said auxiliary towers comprising:

a tower assembly including a base plate, a horizontal member mounted on said base plate and extending inwardly toward the vehicle, a vertical member secured to base plate at the outer end of said horizontal member, a gusset member positioned between said horizontal member and said vertical member, and means for supporting said tower assembly for pivotal movement with respect to the damaged vehicle whereby the chain can be attached to the vehicle and the free end attached to said vertical member to double the tensile force applied to the vehicle.

8. The combination according to claim 7 including an auxiliary plate mounted in a spaced relation to the floor, said supporting means comprising a cap plate assembly including a pair of clamps for engaging said auxiliary plate.

* * * * *